US011073783B2

(12) United States Patent
Ohmura

(10) Patent No.: US 11,073,783 B2
(45) Date of Patent: Jul. 27, 2021

(54) FIXING DEVICE AND IMAGE FORMING APPARATUS

(71) Applicant: Kohki Ohmura, Kanagawa (JP)

(72) Inventor: Kohki Ohmura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/852,740

(22) Filed: Apr. 20, 2020

(65) Prior Publication Data

US 2020/0341424 A1 Oct. 29, 2020

(30) Foreign Application Priority Data

Apr. 26, 2019 (JP) ..... JP2019-085686

(51) Int. Cl.
*G03G 21/16* (2006.01)

(52) U.S. Cl.
CPC ..... *G03G 21/1647* (2013.01); *G03G 21/1685* (2013.01)

(58) Field of Classification Search
CPC ..... G03G 21/1685
See application file for complete search history.

(56) References Cited

U.S. PATENT DOCUMENTS

2006/0008282 A1* 1/2006 Aratachi ..... G03G 21/1685 399/33
2007/0025764 A1* 2/2007 Maeda ..... G03G 15/2035 399/122

FOREIGN PATENT DOCUMENTS

JP 2004-287462 10/2004
JP 2010-097151 4/2010

* cited by examiner

*Primary Examiner* — Victor Verbitsky
(74) *Attorney, Agent, or Firm* — Duft & Bornsen, PC

(57) ABSTRACT

A fixing device is drawn from an image forming apparatus in a drawing direction. The fixing device includes a first unit, a second unit coupled with the first unit, and a third unit coupled with the second unit. A fastener releases coupling between at least two of the first unit, the second unit, and the third unit. An exterior cover is disposed at a front of the image forming apparatus in the drawing direction. The exterior cover includes a slot disposed opposite the fastener.

18 Claims, 6 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-085686, filed on Apr. 26, 2019, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ a fixing device that fixes a toner image on a recording medium such as a transfer sheet. For example, the fixing device includes a fixing rotator (e.g., a fixing roller and a fixing belt) and a pressure rotator (e.g., a pressure roller). The pressure rotator is pressed against the fixing rotator that is heated to form a nip therebetween. As the recording medium passes through the nip, the fixing rotator and the pressure rotator melt toner of the toner image borne on the recording medium, fixing the toner image on the recording medium.

The fixing device incorporates a plurality of components that is replaced periodically in addition to a case when the fixing device suffers from failure. Hence, work such as maintenance and replacement of the components is performed according to a usage condition.

The work is mainly performed by a service engineer. Processes of the work may influence load imposed on the service engineer and labor costs of the service engineer, that increase costs imposed on a user. Hence, technology to improve and facilitate the work of the service engineer is proposed.

SUMMARY

This specification describes below an improved fixing device. In one embodiment, the fixing device is drawn from an image forming apparatus in a drawing direction. The fixing device includes a first unit, a second unit coupled with the first unit, and a third unit coupled with the second unit. A fastener releases coupling between at least two of the first unit, the second unit, and the third unit. An exterior cover is disposed at a front of the image forming apparatus in the drawing direction. The exterior cover includes a slot disposed opposite the fastener.

This specification further describes an improved image forming apparatus. In one embodiment, the image forming apparatus includes an image bearer that bears an image and a fixing device that fixes the image on a recording medium. The fixing device is drawn from the image forming apparatus in a drawing direction. The fixing device includes a first unit, a second unit coupled with the first unit, and a third unit coupled with the second unit. A fastener releases coupling between at least two of the first unit, the second unit, and the third unit. An exterior cover is disposed at a front of the image forming apparatus in the drawing direction. The exterior cover includes a slot disposed opposite the fastener.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
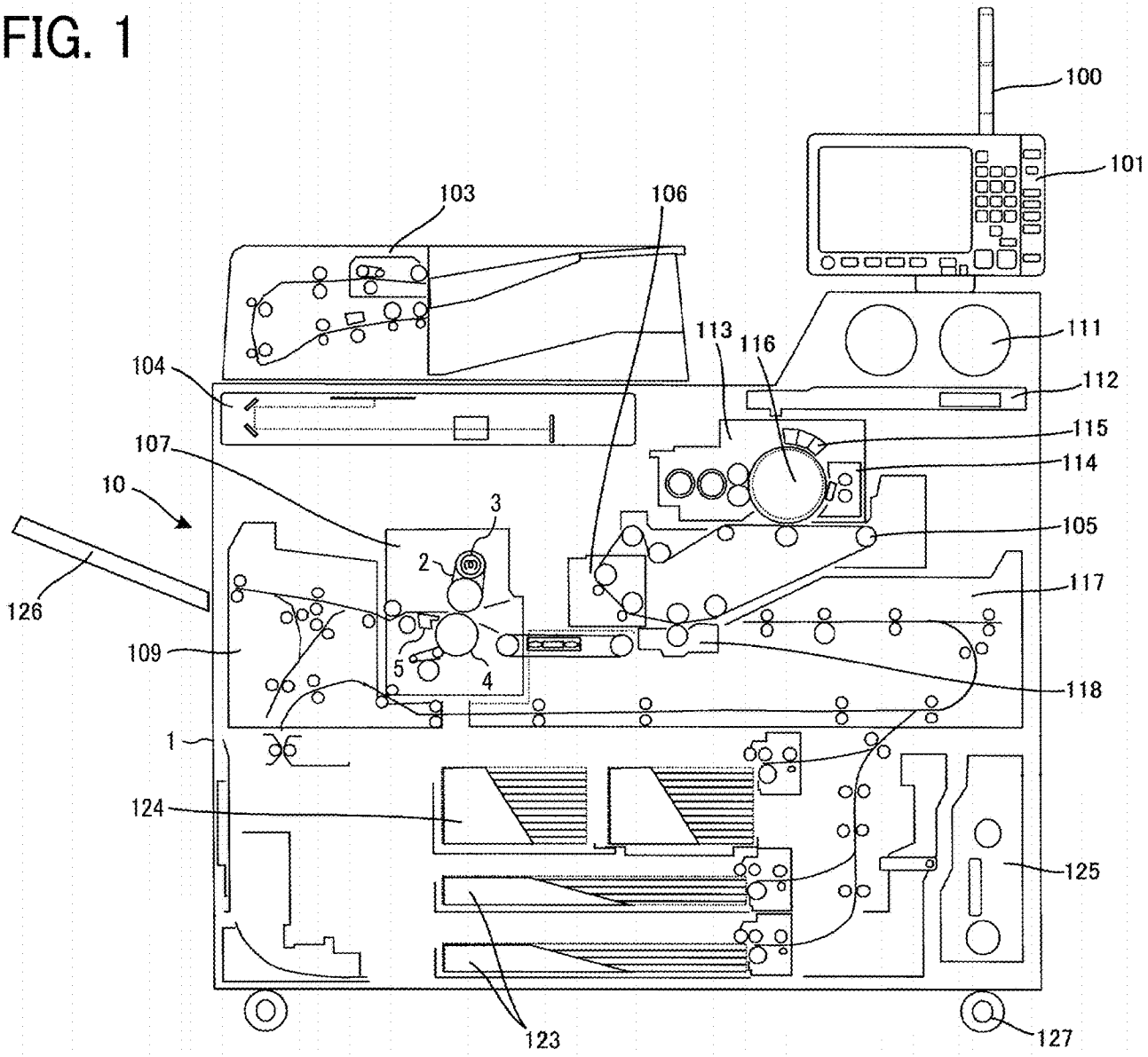
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a fixing device and an image forming apparatus according to embodiments of the present disclosure.

Technology of the embodiments of the present disclosure is not limited to embodiments described below and may be modified within scopes suggested by those skilled in art, such as other embodiments, addition, modification, and deletion. The technology of the embodiments of the present disclosure encompasses various embodiments that achieve operations and advantages of the embodiments of the present disclosure.

Referring to FIG. 1, a description is provided of a construction of an image forming apparatus 10 according to an embodiment of the present disclosure.

FIG. 1 is a schematic cross-sectional view of the image forming apparatus 10. For example, the image forming apparatus 10 is a copier that forms a monochrome toner image. Additionally, the image forming apparatus 10 also serves as a printer when the image forming apparatus 10 is connected to a personal computer.

Since the image forming apparatus 10 according to this embodiment is the copier, the image forming apparatus 10 includes an original reader that serves as a scanner. Alternatively, if the image forming apparatus 10 is a machine connected to a personal computer and exclusively used to output a print, such as a printer, and therefore incorporates a controller, the image forming apparatus 10 may omit the original reader.

The following describes a schematic construction and operations of the image forming apparatus 10 according to this embodiment.

The image forming apparatus 10 includes a scanner unit 104 that accommodates an illumination device, an optical system, a charge coupled device (CCD) image sensor, and the like.

Above the scanner unit 104 is an auto document feeder (ADF) unit 103 that feeds an original bearing an image. The ADF unit 103 conveys the original automatically to a reading face of an exposure glass.

An operator places the original on the exposure glass disposed in an upper portion of the scanner unit 104 or in the ADF unit 103. The operator selects a mode by using function selecting keys on a control panel 101. While checking information displayed on a liquid crystal screen, the operator sets desired image forming conditions by using numeric keys, function keys, and the like on the control panel 101. The image forming apparatus 10 incorporates a call indicator light 100 that notifies an operation status of the image forming apparatus 10 to the operator.

A sensor board unit (SBU) performs analog to digital (A/D) conversion on an image signal created by the scanner unit 104 that reads the image on the original. Thereafter, a laser writing unit 112 irradiates a photoconductive drum 116 with a laser beam. For example, a cylindrical lens of the laser writing unit 112 collects the laser beam. A polygon mirror causes the laser beam to scan the photoconductive drum 116 linearly in a main scanning direction, forming an electrostatic latent image on the photoconductive drum 116.

A developing unit 113 includes a cleaning unit 114 and a charger 115 that surround the photoconductive drum 116. The charger 115 is used to charge a surface of the photoconductive drum 116.

A power supply unit (PSU) applies a high voltage to the charger 115 through a receptacle, an electrode terminal, a conductive bearing, and the like.

A conveying screw disposed inside the developing unit 113 stirs and mixes toner that is supplied from a toner supply unit 111 (e.g., a toner bottle) as needed and a developer that replenishes the developing unit 113 in advance and conveys the toner and the developer to a developing roller. The toner attracted electrostatically to the developing roller with a magnetic force is charged negatively.

A developer rising restrictor, such as a doctor blade and a casing, disposed below the developing roller restricts a two-component developer borne on the developing roller to an appropriate amount. Thereafter, a bias voltage moves toner of the two-component developer, that is charged frictionally, onto the photoconductive drum 116, adhering the toner to the electrostatic latent image selectively and forming a toner image. Thus, the photoconductive drum 116 serves as an image bearer that bears an image.

A toner density sensor disposed on a bottom face of the developing unit 113 detects the density of toner inside the developing unit 113 based on an amount of the charged toner.

After the toner image is transferred from the photoconductive drum 116, a cleaning blade disposed inside the cleaning unit 114 scrapes residual toner failed to be transferred and remained on the photoconductive drum 116 from the photoconductive drum 116 so that the residual toner is conveyed and collected into a waste toner bottle 125.

The developing unit 113 is surrounded properly by a Mylar® that prevents the toner from scattering and an entrance seal that is made of a sponge material.

The visible toner image formed on the photoconductive drum 116 with the toner is transferred onto and borne on an intermediate transfer belt unit 105 temporarily.

A transfer sheet is conveyed by a sheet conveyer 117 and passed through a registration portion. While the transfer sheet passes through a nip formed between the intermediate transfer belt unit 105 and a secondary transfer unit 118, a secondary transfer roller charges the toner of the toner image positively, transferring the toner image formed on the intermediate transfer belt unit 105 onto the transfer sheet.

After the toner image is transferred from the intermediate transfer belt unit 105, a cleaning blade disposed inside a belt cleaning unit 106 scrapes residual toner failed to be transferred and remained on the intermediate transfer belt unit 105 from the intermediate transfer belt unit 105 so that the residual toner is conveyed and collected into the waste toner bottle 125.

The PSU applies a high voltage to the secondary transfer roller through the receptacle, the electrode terminal, the conductive bearing, and the like.

In order to restrict fluctuation of a transfer electric current caused by a print environment, the type of a transfer sheet, and the like, the secondary transfer roller is performed with a constant electric current control. Additionally, the transfer electric current is switched properly according to selection of sheet feeding trays 123 and 124 (e.g., paper trays), the size of the transfer sheet, the thickness of the transfer sheet, and the like.

In order to prevent the toner adhered to the secondary transfer roller from staining a back side of the transfer sheet, the secondary transfer roller is applied with a negative bias at a predetermined time, thus returning the toner adhered to the secondary transfer roller to the intermediate transfer belt unit 105. Accordingly, the secondary transfer roller is cleaned.

The transfer sheet transferred with the toner image is conveyed to a fixing device 107 (e.g., a fuser unit). The fixing device 107 melts and fixes the toner image on the transfer sheet under constant temperature and pressure.

The fixing device 107 includes a fixing roller disposed opposite a thermistor that detects the temperature of a surface of the fixing roller. Thus, the thermistor controls turning on and off of a heater. The thermistor may be a contact type thermistor that contacts the fixing roller or a non-contact type thermistor that does not contact the fixing roller. The fixing device 107 further includes a thermal fuse that prevents overheating.

The fixing device 107 according to the embodiments includes at least a fixing rotator (e.g., a fixing member), a heater 3, and a pressure rotator (e.g., a pressure member). For example, the fixing device 107 includes a fixing belt 2 serving as a fixing rotator that is stretched taut across a plurality of rollers. A pressure roller 4 serving as a pressure rotator presses against the fixing belt 2 to form a nip therebetween. A cam adjusts pressurization and depressurization of the pressure roller 4 at the nip.

Other construction of the fixing device 107 is described below.

A fixing separation plate separates the transfer sheet bearing the toner image thermally fixed to the transfer sheet from the fixing belt 2 and the pressure roller 4. Thereafter, the transfer sheet passes through a reverse sheet ejection unit 109 or is performed with duplex printing according to a condition set by the operator. Thereafter, the transfer sheet is ejected onto a sheet ejection tray 126. Alternatively, if a finisher or the like is coupled with the image forming apparatus 10, the transfer sheet is conveyed to a transfer sheet entry of the finisher.

The image forming apparatus 10 further includes body moving casters 127.

The image forming apparatus 10 according to this embodiment forms the toner image on the transfer sheet by electrophotography with the construction and the operations described above.

A description is provided of a comparative construction that facilitates replacement of a belt unit.

In a state in which the belt unit is attached to a base, a drawing mechanism draws the base together with the belt unit from an operation position inside a body to a predetermined work position. Before a service engineer starts removing the belt unit, a detector is retracted to a retracted position where the detector does not interfere with a belt. After the service engineer finishes installation of the belt unit, the detector returns to a regular detecting position.

The comparative construction improves replacement of the belt unit. However, it is also requested to improve work such as maintenance of components of other unit and replacement of parts.

Referring to FIGS. 2, 3, 4, 5A, and 5B, a description is provided of a construction of the fixing device 107 according to the embodiments of the present disclosure.

Figure 2:
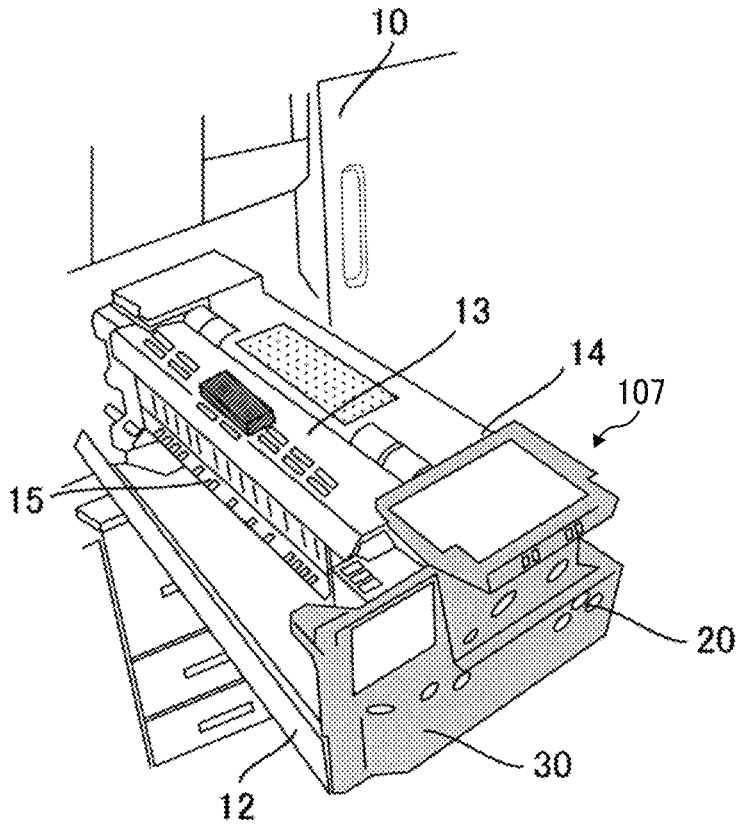
FIG. 2 is a perspective view of a fixing device installed in the image forming apparatus depicted in FIG. 1, schematically illustrating the fixing device drawn from the image forming apparatus.

As illustrated in FIG. 2, the fixing device 107 according to the embodiments is mounted on a slide rail 12 such that the fixing device 107 is pulled and drawn to an outside of the image forming apparatus 10. The fixing device 107 includes an exterior cover 30 that is made of resin and disposed at a front of the image forming apparatus 10 in a drawing direction in which the fixing device 107 is drawn. The exterior cover 30 includes a plurality of slots 20 through which the operator accesses fasteners.

The fixing device 107 according to the embodiments includes a heating unit 14, a pressure unit 15, and a separation unit 13. As illustrated in FIG. 1, the heating unit 14 includes the fixing belt 2 serving as a fixing rotator or a fixing member and the heater 3. The pressure unit 15 includes the pressure roller 4 serving as a pressure rotator or a pressure member that contacts the fixing belt 2 to form the nip between the fixing belt 2 and the pressure roller 4. The separation unit 13 includes a separator 5 that separates a transfer sheet serving as a recording medium from the pressure roller 4 and the fixing belt 2 after the transfer sheet bearing a fixed toner image passes through the nip.

The heating unit 14 includes the fixing belt 2 and the heater 3. According to this embodiment, the fixing belt 2 serves as a fixing rotator. Alternatively, a roller or a combination of a roller and a belt may serve as a fixing rotator. The pressure unit 15 includes the pressure roller 4 serving as a pressure rotator. The separation unit 13 includes the separator 5 that is a separation plate or the like.

A description is provided of one example of processes for maintenance of the fixing device 107, replacement of parts and components of the fixing device 107, and the like.

Maintenance of the fixing device 107 and replacement of parts and components of the fixing device 107 are performed according to failure and a usage condition (e.g., a counter value relative to a set value as a life of the fixing device 107).

First, after the image forming apparatus 10 depicted in FIG. 2 finishes printing, the operator draws the fixing device 107 placed on the slide rail 12. The operator preferably draws the fixing device 107 after the fixing device 107 is cooled sufficiently.

Next, the operator removes an entirety of the fixing device 107 or at least one of the units, that is, the separation unit 13, the heating unit 14, and the pressure unit 15, from the slide rail 12. The operator stationarily places the fixing device 107 or the at least one of the units on a work space and starts maintenance.

Figure 3:
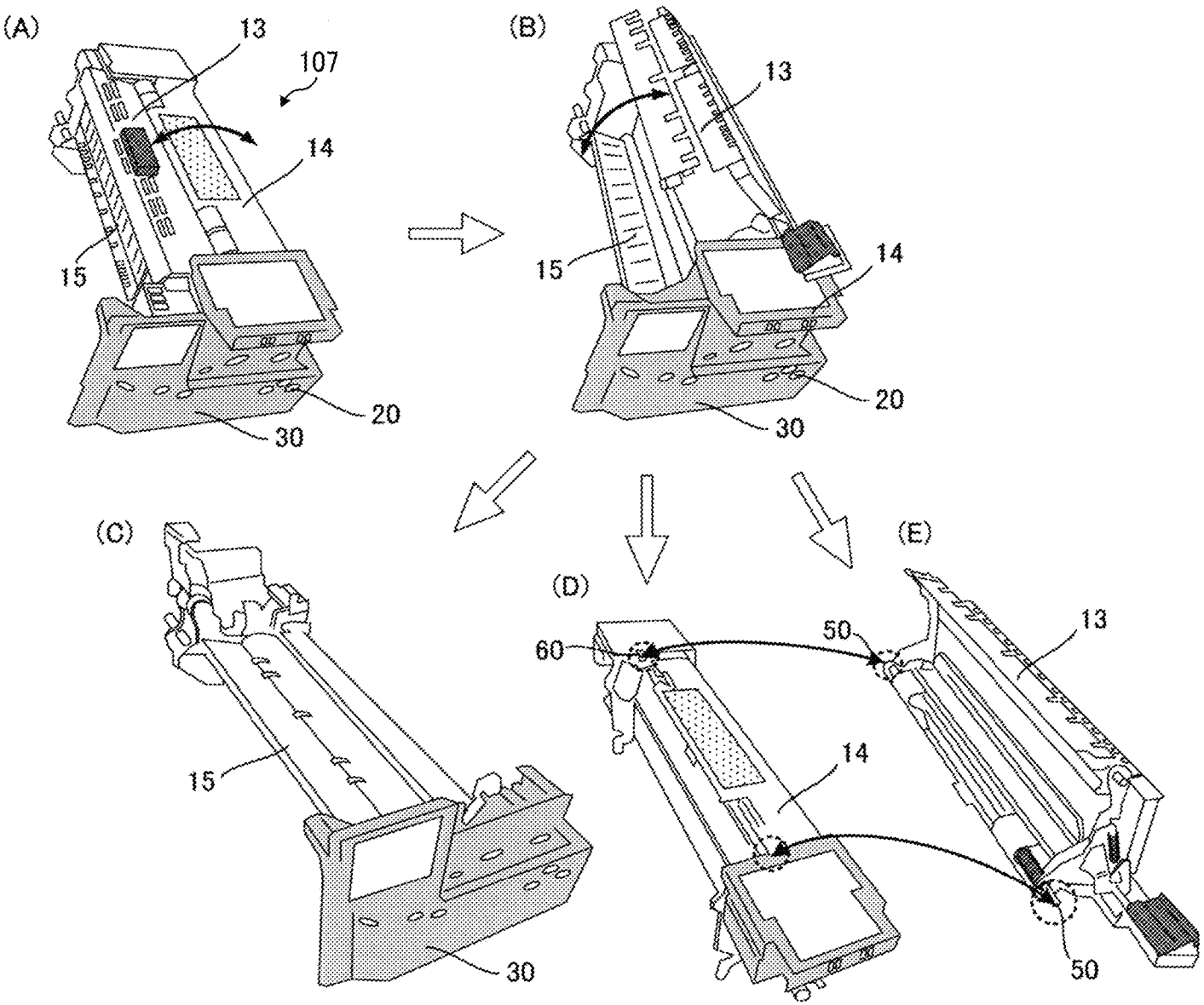
FIG. 3 is a perspective view of the fixing device depicted in FIG. 2, schematically illustrating the fixing device divided into a pressure unit, a heating unit, and a separation unit.
Figure 4:
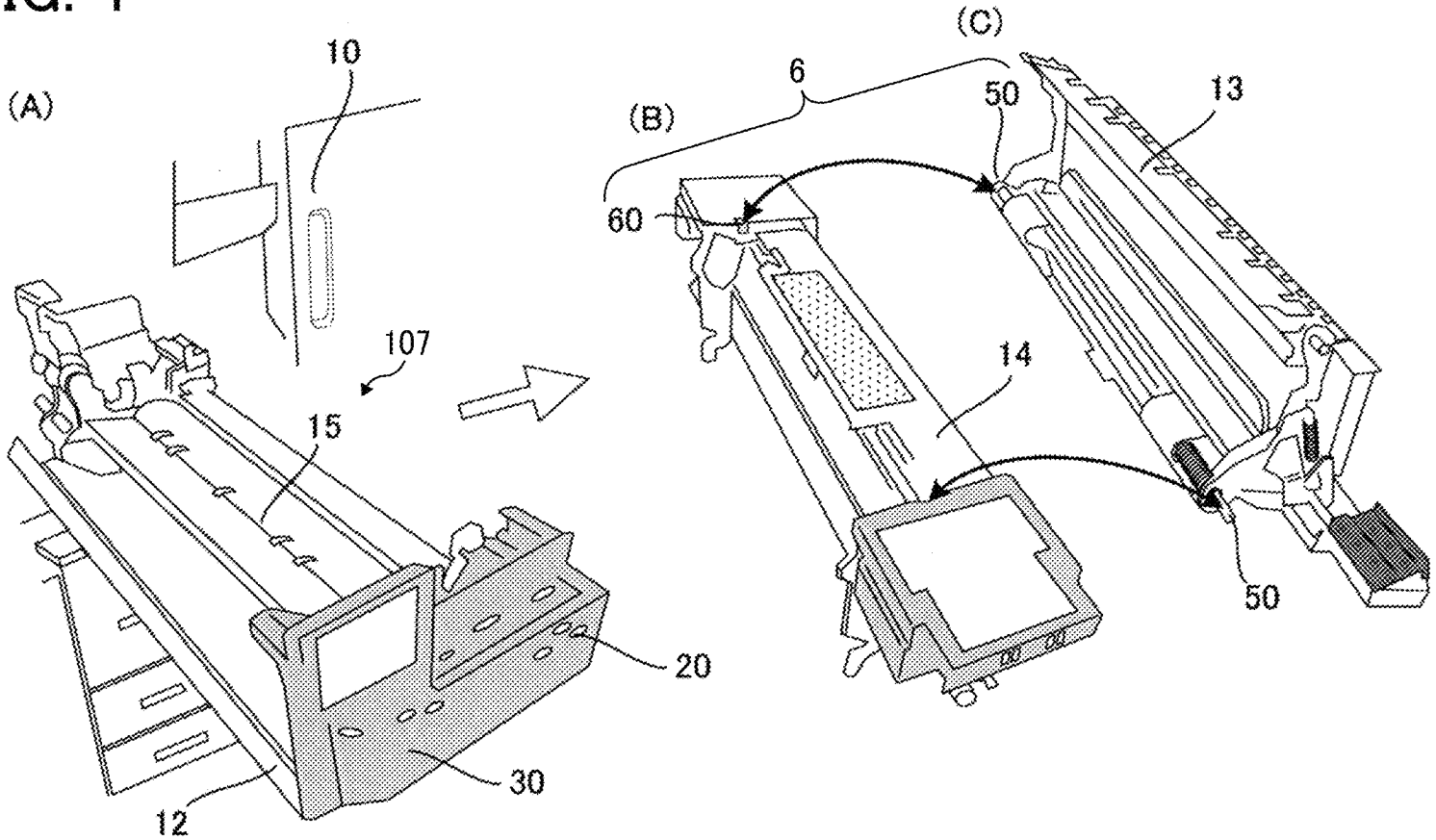
FIG. 4 is a perspective view of the fixing device depicted in FIG. 2, schematically illustrating the fixing device divided into the pressure unit, the heating unit, and the separation unit while the pressure unit is mounted on a slide rail.

The operator releases the fasteners that couple the separation unit 13, the heating unit 14, and the pressure unit 15, thus separating the separation unit 13, the heating unit 14, and the pressure unit 15 from each other as illustrated in FIGS. 3 and 4.

After the fixing device 107 is divided into the separation unit 13, the heating unit 14, and the pressure unit 15, the operator performs necessary maintenance, replacement of parts, and the like for a target one of the separation unit 13, the heating unit 14, and the pressure unit 15.

After the operator finishes work such as maintenance and replacement of parts, the operator combines the separation unit 13, the heating unit 14, and the pressure unit 15 into the fixing device 107, places the fixing device 107 on the slide rail 12, and presses the fixing device 107 into the image forming apparatus 10.

The fixing device 107 according to the embodiments is installed in the image forming apparatus 10 such that the fixing device 107 is drawn from a body 1 of the image forming apparatus 10 depicted in FIG. 1. The fixing device 107 includes the exterior cover 30 disposed at the front of the image forming apparatus 10 in the drawing direction in which the fixing device 107 is drawn. The fixing device 107 further includes the heating unit 14, the pressure unit 15, and the separation unit 13. As illustrated in FIG. 1, the heating unit 14 includes the fixing belt 2 serving as a fixing rotator or a fixing member and the heater 3. The pressure unit 15 includes the pressure roller 4 serving as a pressure rotator or a pressure member that contacts the fixing belt 2 to form the nip between the fixing belt 2 and the pressure roller 4. The separation unit 13 includes the separator 5 that separates a transfer sheet serving as a recording medium bearing a fixed toner image from at least one of the pressure roller 4 and the fixing belt 2 after the transfer sheet passes through the nip.

The exterior cover 30 includes the slots 20 through which the operator accesses the fasteners with which the operator releases coupling of the heating unit 14, the pressure unit 15, and the separation unit 13. The fixing device 107 includes the plurality of fasteners and the plurality of slots 20 that are disposed opposite the fasteners. The operator removes the fasteners used to release coupling of the heating unit 14, the pressure unit 15, and the separation unit 13 through the slots 20 of the exterior cover 30.

Thus, the operator separates the heating unit 14, the pressure unit 15, and the separation unit 13 from each other without removing the exterior cover 30 from the fixing device 107.

FIG. 3 illustrates the separation unit 13, the heating unit 14, and the pressure unit 15 that are coupled in a section (A). FIG. 3 illustrates the separation unit 13 that is exposed in a section (B). FIG. 3 illustrates the pressure unit 15 in a section (C), the heating unit 14 in a section (D), and the separation unit 13 in a section (E), that are separated from each other.

As illustrated in FIG. 3, the fixing device 107 according to the embodiments is divided into the pressure unit 15, the heating unit 14, and the separation unit 13 without removal of the exterior cover 30 from the fixing device 107. For example, the exterior cover 30 is mounted on the pressure unit 15.

Alternatively, the operator may release coupling between two units of the pressure unit 15, the heating unit 14, and the separation unit 13 as needed according to work of the operator or the work space that is ensured.

FIG. 4 illustrates the pressure unit 15 mounted on the slide rail 12 in a section (A). FIG. 4 illustrates the heating unit 14 and the separation unit 13, that are separated from the pressure unit 15, in sections (B) and (C), respectively.

For example, as illustrated in FIG. 4, in a state in which the fixing device 107 is drawn from the image forming apparatus 10, the operator divides the fixing device 107 into the pressure unit 15, the heating unit 14, and the separation unit 13 without removing the exterior cover 30 from the fixing device 107. Additionally, the operator separates the heating unit 14 from the separation unit 13 as needed.

The fixing device 107 having the construction described above improves work of the operator (e.g., a service engineer) to perform maintenance and replacement of parts for each of the pressure unit 15, the heating unit 14, and the separation unit 13 that construct the fixing device 107, thus reducing labor costs (e.g., service costs).

Additionally, improvement in work of the operator decreases risks of attachment errors and damage of parts of the fixing device 107.

Additionally, the operator moves the pressure unit 15, the heating unit 14, and the separation unit 13 without separating the pressure unit 15, the heating unit 14, and the separation unit 13 from each other entirely so that the operator accesses necessary parts and components of at least one of the pressure unit 15, the heating unit 14, and the separation unit 13.

For example, as illustrated in the section (B) in FIG. 3, the operator secures the separation unit 13 and the heating unit 14 without separating the separation unit 13 from the heating unit 14 such that the separation unit 13 is exposed to the operator to allow the operator to access the necessary components inside the separation unit 13. Accordingly, the fixing device 107 improves work of the operator who replaces the separator 5 (e.g., the separation plate) of the separation unit 13.

A biasing member such as a spring is interposed between the separation unit 13 and the heating unit 14 to couple the separation unit 13 with the heating unit 14. The biasing member biases the separation unit 13 against the heating unit 14 so that the separation unit 13 is secured to the heating unit 14 at an exposure position where the separation unit 13 is exposed to the operator as illustrated in the section (B) in FIG. 3.

As illustrated in the section (E) in FIG. 3, the separation unit 13 pivots about a support shaft 50 to the exposure position.

As illustrated in the sections (D) and (E) in FIG. 3 and the sections (B) and (C) in FIG. 4, the separation unit 13 accommodates the support shaft 50 that pivotably supports the separation unit 13. The heating unit 14 accommodates fitting grooves 60 (e.g., recesses) that fit the support shaft 50.

As the support shaft 50 fits the fitting grooves 60, the separation unit 13 is coupled with the heating unit 14. As the support shaft 50 separates from the fitting grooves 60, the separation unit 13 separates from the heating unit 14. Thus, the support shaft 50 and the fitting groove 60 construct a fastener 6.

Referring to FIGS. 5A, 5B, 6A, 6B, 7A, 7B, 8A, and 8B, a description is provided of a relation between the support shaft 50 and the fitting grooves 60.

Figure 5A:
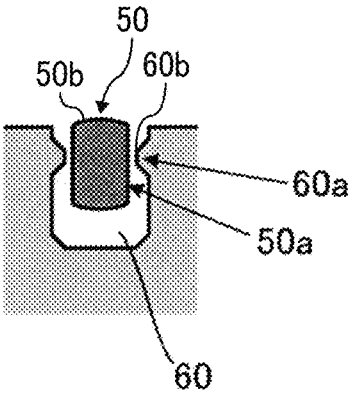
FIG. 5A is a cross-sectional view of a support shaft and a fitting groove incorporated in the fixing device depicted in FIG. 4 when the separation unit is attached to and detached from the heating unit.

As illustrated in FIG. 5A, the support shaft 50 includes milling faces 50*a* that are disposed on at least a part of the support shaft 50 and are opposite each other. The support shaft 50 further includes an oval portion 50*b* that is substantially oval in a cross section that is perpendicular to an axial direction of the support shaft 50. The fitting groove 60 includes a constriction 60*b* that is disposed in at least a part of the fitting groove 60. The milling faces 50*a* of the support shaft 50 pass through the constriction 60*b*. The constriction 60*b* is defined by projections 60*a* that project from an interior wall face of the fitting groove 60.

Figure 5B:
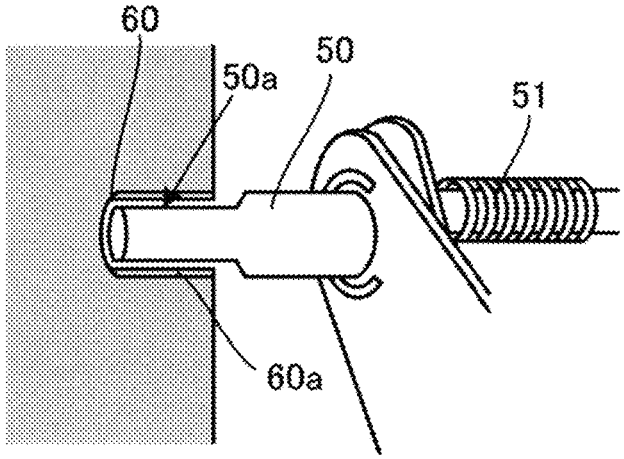
FIG. 5B is a perspective view of the support shaft and the fitting groove depicted in FIG. 5A.

As illustrated in FIG. 5B, a biasing member 51 (e.g., a coil spring) biases the support shaft 50.

Figure 6A:
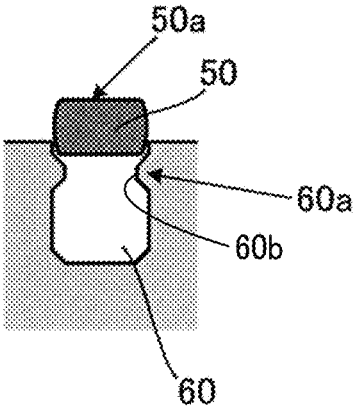
FIG. 6A is a cross-sectional view of the support shaft and the fitting groove depicted in FIG. 5A in a state in which the separation unit separates from the heating unit.
Figure 6B:
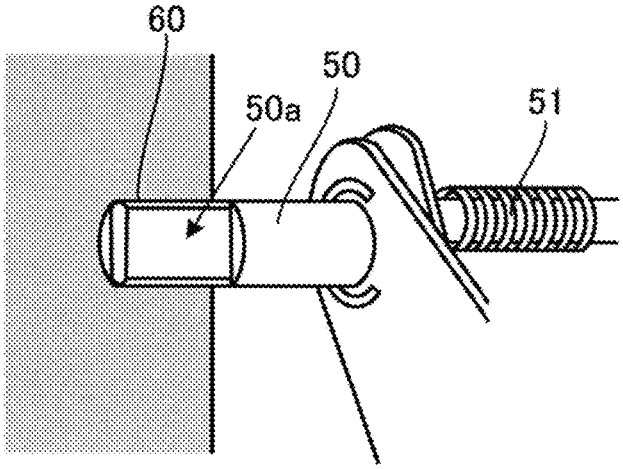
FIG. 6B is a perspective view of the support shaft and the fitting groove depicted in FIG. 6A.
Figure 7A:
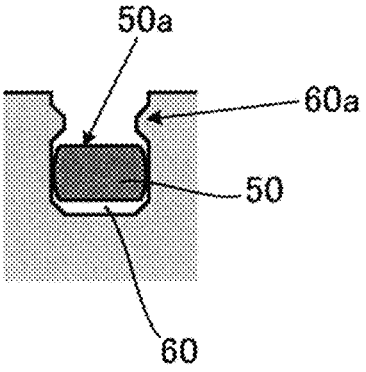
FIG. 7A is a cross-sectional view of the support shaft and the fitting groove depicted in FIG. 5A in a state in which the separation unit is secured to the heating unit.
Figure 7B:
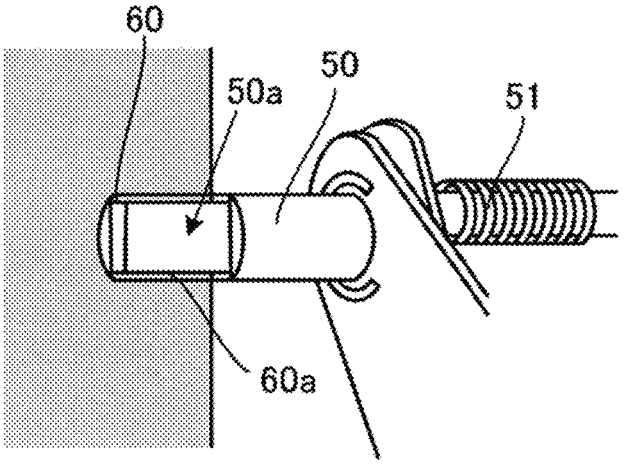
FIG. 7B is a perspective view of the support shaft and the fitting groove depicted in FIG. 7A.

FIGS. 5A, 6A, and 7A illustrate a schematic diagram of a milling face portion of the support shaft 50, that has the milling faces 50*a*, in the cross section perpendicular to the axial direction of the support shaft 50. FIGS. 5B, 6B, and 7B illustrate a top perspective view of the support shaft 50 in a horizontal surface in the axial direction of the support shaft 50.

Figure 8A:
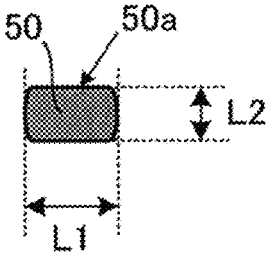
FIG. 8A is a cross-sectional view of the support shaft depicted in FIG. 7A, illustrating diameters of the support shaft.
Figure 8B:
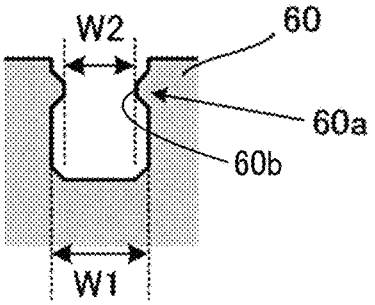
FIG. 8B is a cross-sectional view of the fitting groove depicted in FIG. 7A, illustrating widths of the fitting groove.

FIG. 8A is a schematic diagram of the milling face portion of the support shaft 50, that has the milling faces 50*a*, in the cross section perpendicular to the axial direction of the support shaft 50. FIG. 8B is a schematic diagram of the fitting groove 60 in the cross section perpendicular to the axial direction of the support shaft 50.

As illustrated in FIG. 8A, the milling face portion of the support shaft 50, that has the milling faces 50*a*, is substantially oval in the cross section perpendicular to the axial direction of the support shaft 50. The support shaft 50 has a diameter L1. The milling faces 50*a* that are opposite each other define a diameter L2. On the other hand, as illustrated in FIG. 8B, the fitting groove 60 has a width W1 in the cross section perpendicular to the axial direction of the support shaft 50. The constriction 60*b* defined by the projections 60*a* has a width W2.

The width W1 is greater than the diameter L1. The diameter L1 is greater than the width W2. The width W2 is greater than the diameter L2. That is, the width W1, the diameter L1, the width W2, and the diameter L2 satisfy a relation of W1>L1>W2>L2.

FIGS. 5A and 5B illustrate a state in which, when the operator performs attachment and detachment of the separation unit 13 with respect to the heating unit 14, the milling faces 50*a* of the support shaft 50 pass through the constriction 60*b* defined by the projections 60*a*.

The milling faces 50*a* of the support shaft 50 are directed in a direction in which the milling faces 50*a* facilitate the operator to insert the support shaft 50 into the fitting groove 60, thus allowing the support shaft 50 to pass through the constriction 60*b* of the fitting groove 60.

FIGS. 6A and 6B illustrate a state in which the separation unit 13 separates from the heating unit 14 and the support shaft 50 does not fit the fitting groove 60.

If the support shaft 50 is angled such that the milling faces 50*a* of the support shaft 50 do not face the projections 60*a* of the fitting groove 60, the support shaft 50 does not pass through the constriction 60*b* defined by the projections 60*a* of the fitting groove 60.

FIGS. 7A and 7B illustrate a state in which the separation unit 13 is attached and secured to the heating unit 14 and the support shaft 50 fits the fitting groove 60.

As illustrated in FIGS. 5A and 5B, the operator adjusts the direction of the milling faces 50*a* of the support shaft 50 and passes the support shaft 50 through the constriction 60*b* defined by the projections 60*a*. Thereafter, the operator rotates the support shaft 50 so that the direction of the milling faces 50*a* changes by substantially 90 degrees. Thus, the support shaft 50 is retained without being dropped from the fitting groove 60.

As described above, with the fixing device 107 according to the embodiments, the operator adjusts the direction of the milling faces 50*a* of the support shaft 50. Accordingly, the operator performs operations for attachment and detachment of the separation unit 13 with respect to the heating unit 14 and dislocation of the separation unit 13 and the heating unit 14 readily without a tool and the like.

As described above, the fixing device 107 according to the embodiments improves work of the operator, such as maintenance and replacement of parts of functional units (e.g., the separation unit 13, the heating unit 14, and the pressure unit 15) that construct the fixing device 107.

A description is provided of advantages of a fixing device (e.g., the fixing device 107).

As illustrated in FIGS. 1 and 2, the fixing device is installed in a body (e.g., the body 1) of an image forming apparatus (e.g., the image forming apparatus 10) such that the fixing device is drawn from the body of the image forming apparatus. The fixing device includes an exterior cover (e.g., the exterior cover 30) disposed at a front of the image forming apparatus in a drawing direction in which the fixing device is drawn from the image forming apparatus. The fixing device further includes a heating unit (e.g., the heating unit 14), a pressure unit (e.g., the pressure unit 15), and a separation unit (e.g., the separation unit 13). The heating unit includes a fixing rotator (e.g., the fixing belt 2) and a heater (e.g., the heater 3). The pressure unit includes a pressure rotator (e.g., the pressure roller 4) that contacts the fixing rotator to form a nip between the fixing rotator and the pressure rotator. The separation unit includes a separator (e.g., the separator 5) that separates a recording medium bearing a fixed toner image from at least one of the fixing rotator and the pressure rotator after the recording medium passes through the nip. The fixing device further includes a fastener (e.g., the fastener 6 depicted in FIG. 4) that releases coupling between at least two of the heating unit, the pressure unit, and the separation unit. The exterior cover includes a slot (e.g., the slot 20) disposed opposite the fastener so that an operator accesses the fastener through the slot.

Accordingly, the fixing device improves work of the operator such as maintenance and replacement of parts of the heating unit, the pressure unit, and the separation unit that construct the fixing device.

According to the embodiments described above, the fixing belt 2 serves as a fixing rotator. Alternatively, a fixing roller, a fixing film, a fixing sleeve, or the like may be used as a fixing rotator. Further, the pressure roller 4 serves as a pressure rotator. Alternatively, a pressure belt or the like may be used as a pressure rotator.

According to the embodiments described above, the image forming apparatus 10 is a copier. Alternatively, the image forming apparatus 10 may be a printer, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device configured to be drawn from an image forming apparatus in a drawing direction, the fixing device comprising:

a first unit;

a second unit coupled with the first unit;

a third unit coupled with the second unit;

a fastener configured to release coupling between at least two of the first unit, the second unit, and the third unit; and an exterior cover disposed at a front of the image forming apparatus in the drawing direction, the exterior cover including a slot disposed opposite the fastener, wherein an operator accesses the fastener through the slot.

2. The fixing device according to claim 1, wherein the fastener includes:

a support shaft disposed in the third unit and configured to support the third unit pivotably; and a fitting groove disposed in the second unit and configured to fit the support shaft.

3. The fixing device according to claim 2, wherein the support shaft includes:

an oval portion configured to be substantially oval in a cross section perpendicular to an axial direction of the support shaft;

a first planar contact face on the oval portion; and a second planar contact face on the oval portion and configured to be opposite the first planar contact face, and wherein the fitting groove includes a constriction through which the first planar contact face and the second planar contact face pass.

4. The fixing device according to claim 3,
wherein the fitting groove includes a projection configured to define the constriction.

5. The fixing device according to claim 3,
wherein the first planar contact face and the second planar contact face are configured to define a first diameter,
wherein the constriction has a first width configured to be greater than the first diameter,
wherein the support shaft has a second diameter configured to be greater than the first width, and
wherein the fitting groove has a second width in the cross section perpendicular to the axial direction of the support shaft, the second width configured to be greater than the second diameter.

6. The fixing device according to claim 1,
wherein the first unit is configured to separate from the second unit and the third unit in a state in which the fixing device is drawn from the image forming apparatus.

7. The fixing device according to claim 1,
wherein the first unit, the second unit, and the third unit separate from each other.

8. The fixing device according to claim 1,
wherein the second unit includes a heating unit including:
a fixing rotator; and
a heater configured to heat the fixing rotator,
wherein the first unit includes a pressure unit including a pressure rotator configured to contact the fixing rotator to form a nip between the fixing rotator and the pressure rotator, and
wherein the third unit includes a separation unit including a separator configured to separate a recording medium bearing a fixed image from at least one of the fixing rotator and the pressure rotator after the recording medium passes through the nip.

9. An image forming apparatus comprising:
an image bearer configured to bear an image; and
a fixing device configured to fix the image on a recording medium and to be drawn from the image forming apparatus in a drawing direction,
the fixing device comprising:
a first unit;
a second unit coupled with the first unit;
a third unit coupled with the second unit;
a fastener configured to release coupling between at least two of the first unit, the second unit, and the third unit; and
an exterior cover disposed at a front of the image forming apparatus in the drawing direction, the exterior cover including a slot disposed opposite the fastener,
wherein an operator accesses the fastener through the slot.

10. The image forming apparatus according to claim 9, further comprising a slide rail configured to mount the fixing device.

11. A fixing device configured to be drawn from an image forming apparatus in a drawing direction, the fixing device comprising:
a first unit;
a second unit coupled with the first unit;
a third unit coupled with the second unit;
a fastener configured to release coupling between at least two of the first unit, the second unit, and the third unit, wherein the fastener includes:
a support shaft disposed in the third unit and configured to support the third unit pivotably; and
a fitting groove disposed in the second unit and configured to fit the support shaft; and
an exterior cover disposed at a front of the image forming apparatus in the drawing direction, the exterior cover including a slot disposed opposite the fastener.

12. The fixing device according to claim 11,
wherein the support shaft includes:
an oval portion configured to be substantially oval in a cross section perpendicular to an axial direction of the support shaft;
a first planar contact face on the oval portion; and
a second planar contact face on the oval portion and configured to be opposite the first planar contact face, and
wherein the fitting groove includes a constriction through which the first planar contact face and the second planar contact face pass.

13. The fixing device according to claim 12,
wherein the fitting groove includes a projection configured to define the constriction.

14. The fixing device according to claim 12,
wherein the first planar contact face and the second planar contact face are configured to define a first diameter,
wherein the constriction has a first width configured to be greater than the first diameter,
wherein the support shaft has a second diameter configured to be greater than the first width, and
wherein the fitting groove has a second width in the cross section perpendicular to the axial direction of the support shaft, the second width configured to be greater than the second diameter.

15. The fixing device according to claim 11,
wherein the first unit is configured to separate from the second unit and the third unit in a state in which the fixing device is drawn from the image forming apparatus.

16. The fixing device according to claim 11,
wherein the first unit, the second unit, and the third unit separate from each other.

17. The fixing device according to claim 11,
wherein the second unit includes a heating unit including:
a fixing rotator; and
a heater configured to heat the fixing rotator,
wherein the first unit includes a pressure unit including a pressure rotator configured to contact the fixing rotator to form a nip between the fixing rotator and the pressure rotator, and
wherein the third unit includes a separation unit including a separator configured to separate a recording medium bearing a fixed image from at least one of the fixing rotator and the pressure rotator after the recording medium passes through the nip.

18. The fixing device according to claim 11, wherein:
wherein an operator accesses the fastener through the slot.

* * * * *